United States Patent [19]

Ouchi

[11] 3,953,724

[45] Apr. 27, 1976

[54] APPARATUS FOR ADJUSTING THE LIGHT SOURCE POSITION OF A LIGHT SOURCE ASSEMBLY

[75] Inventor: Teruo Ouchi, Hachioji, Japan

[73] Assignee: Olympus Optical Company, Ltd., Tokyo, Japan

[22] Filed: Mar. 3, 1975

[21] Appl. No.: 554,403

[30] Foreign Application Priority Data

Apr. 4, 1974 Japan ..... 49-38530[U]

[52] U.S. Cl. ..... 240/44.2; 240/2 MA

[51] Int. Cl.[2] ..... F21V 19/02

[58] Field of Search ..... 240/44.2, 44.25, 44.26, 240/44.27, 2 MA, 2 SP, 44, 153, DIG. 8

[56] References Cited

UNITED STATES PATENTS

| | | | |
|---|---|---|---|
| 1,310,959 | 7/1919 | O'Hara | 240/44.2 |
| 1,512,923 | 10/1924 | Halvorson, Jr. | 240/44.2 |
| 3,341,710 | 9/1967 | Cade | 240/44.2 |
| 3,590,238 | 6/1971 | Arens | 240/44.2 |

FOREIGN PATENTS OR APPLICATIONS

| | | | |
|---|---|---|---|
| 188,901 | 11/1922 | United Kingdom | 240/44.2 |

*Primary Examiner*—Stephen J. Tomsky

*Attorney, Agent, or Firm*—Ostrolenk, Faber, Gerb & Soffen

[57] ABSTRACT

An apparatus for adjusting the light source position of a light source assembly comprises a lamp socket for mounting a lamp at an eccentric position thereon, and a sleeve secured to a lamp housing for mounting the lamp socket so as to be slidable along the axis and rotatable about the axis of the sleeve. By axially sliding the lamp socket relative to the sleeve or by rotating the lamp socket about the axis, the position of the lamp can be optimally adjusted relative to a condenser which is mounted on the lamp housing.

4 Claims, 4 Drawing Figures

APPARATUS FOR ADJUSTING THE LIGHT SOURCE POSITION OF A LIGHT SOURCE ASSEMBLY

BACKGROUND OF THE INVENTION

The invention relates to an apparatus for adjusting the light source position of a light source assembly.

A light source assembly as used in an optical instrument such as microscope or the like comprises a lamp housing which receives a lamp and a condenser lens which concentrates the light from the lamp for the purpose of projection. The most efficient use of the light from the lamp is achieved when the filament of the lamp or the brightest portion thereof is located at a given position on the optical axis of the condenser lens. This requires that an optimal positional relationship be maintained between the lamp and the condenser lens through a continual adjustment.

To support a lamp in an adjustable manner, the prior practice has been to mount a lamp mount on the lamp housing by means of spring or screw means, and to displace the lamp mount either vertically or toward and away from the condenser lens or in a direction transverse to the optical axis of the condenser lens by means of an operating knob. This involves disadvantages that a number of parts such as springs, screws or the like are required for mounting the lamp and the required adjustment is cumbersome.

Summary of the Invention

It is an object of the invention to provide an apparatus for adjusting the light source position of a light source assembly which includes a lamp socket for mounting a lamp at an eccentric position thereon, and a sleeve secured to a lamp housing for mounting the lamp socket so as to be slidable along the axis and rotatable about the axis of the sleeve, thereby enabling an adjustment of the lamp position relative to a condenser by merely displacing the lamp socket with respect to the sleeve.

In the apparatus of the invention, the fact that the lamp is eccentrically mounted on the lamp socket permits a relatively large angular displacement to be achieved by a rotation of the lamp socket about its axis, with the consequence that a mere rotation of the lamp socket results in a comparable effect as that achieved by the prior practice of moving the lamp mount up and down to the condenser lens. In this manner of the invention, the lamp position can be efficiently adjusted by merely moving the lamp socket either axially or angularly around the axis. In addition, the number of parts required is minimized and the ease of assembly is thereby facilitated.

DETAILED DESCRIPTION OF THE PREFERRED EMBODIMENT

Figure 1:
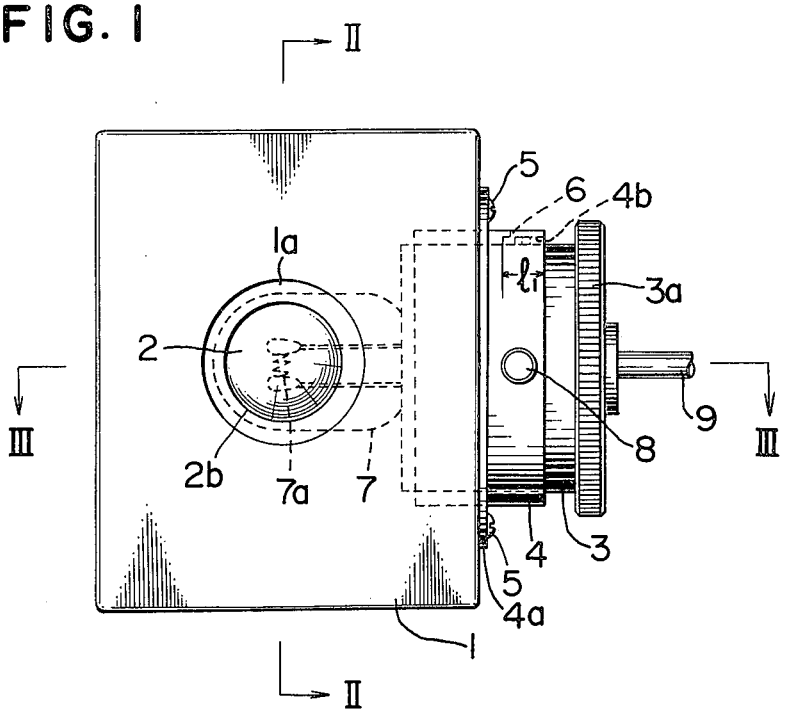
FIG. 1 is a front view of a light source assembly according to one embodiment of the invention.
Figure 2:
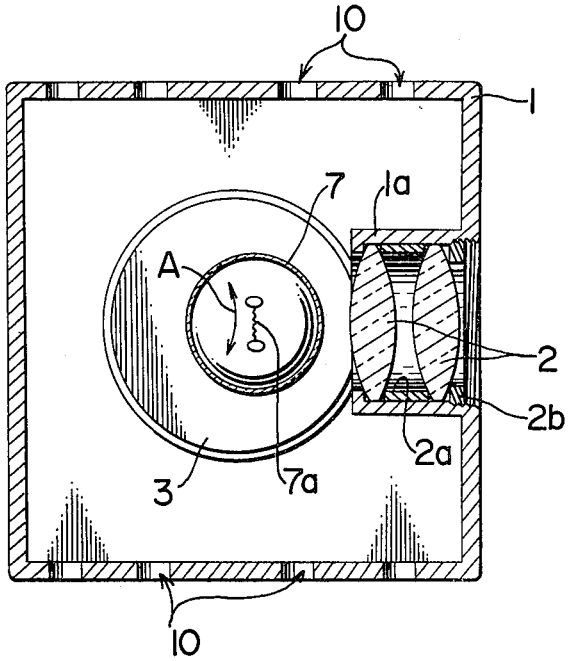
FIG. 2 is a cross section taken along the line II—II shown in FIG. 1.

Referring to FIGS. 1 to 4, a lamp housing 1 is constructed in a light-tight manner, and is integrally formed with a condenser lens barrel 1*a* at a central position, as viewed in FIG. 1. The barrel 1*a* extends inwardly into the housing 1. As shown in FIG. 2, a pair of condenser lenses 2 spaced apart by a spacer ring 2*a* are mounted in the barrel 1*a* and retained therein by means of a retaining ring 2*b*.

Centrally on the right-hand (as viewed in FIG. 1) outer wall of the lamp housing 1 is fixedly mounted a sleeve 4 by securing its flange 4*a* by means of set screws 5. A lamp socket 3 having an outwardly extending operating knob 3*a* is fitted into the sleeve 4, and a lamp 7 is mounted on the inner end of the lamp socket 3 at a position which is offset from the axis 30 thereof (see FIG. 4). Thus, the lamp 7 is mounted at an eccentric position on the lamp socket 3. For the purpose of the invention, it is sufficient that the brightest portion or the filament 7*a* of the lamp 7 be located off the axis 30 of the lamp socket 3. An upstanding pin 6 (see FIG. 4) is fixedly mounted on the outer periphery of the lamp socket 3 at the top thereof, while a groove 4*b* having a fixed depth $l_1$ (see FIG. 1) and a length $l_2$ (see FIG. 4) is formed in the inner periphery of the sleeve 4 so as to extend parallel to the axis 30. The lamp socket 3 is fitted into the sleeve 4 with the lamp 7 initially inserted and with the pin 6 located within the groove 4*b*. When the lamp socket 3 is fitted into the sleeve 4, the lamp socket 3 is secured to the sleeve 4 by means of set screw 8. It will be noted from FIG. 2 that the lamp housing 1 is provided with a number of ventilation openings 10 and that the outer end of the lamp socket 3 is associated with a power feed cord 9.

Figure 3:
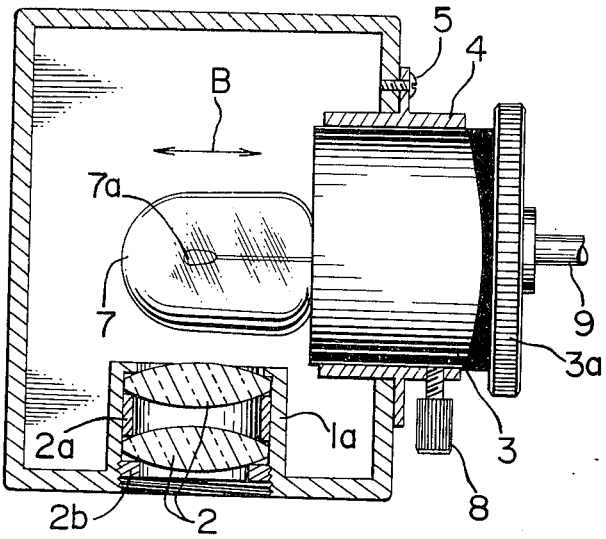
FIG. 3 is a cross section taken along the line III—III shown in FIG. 1.
Figure 4:
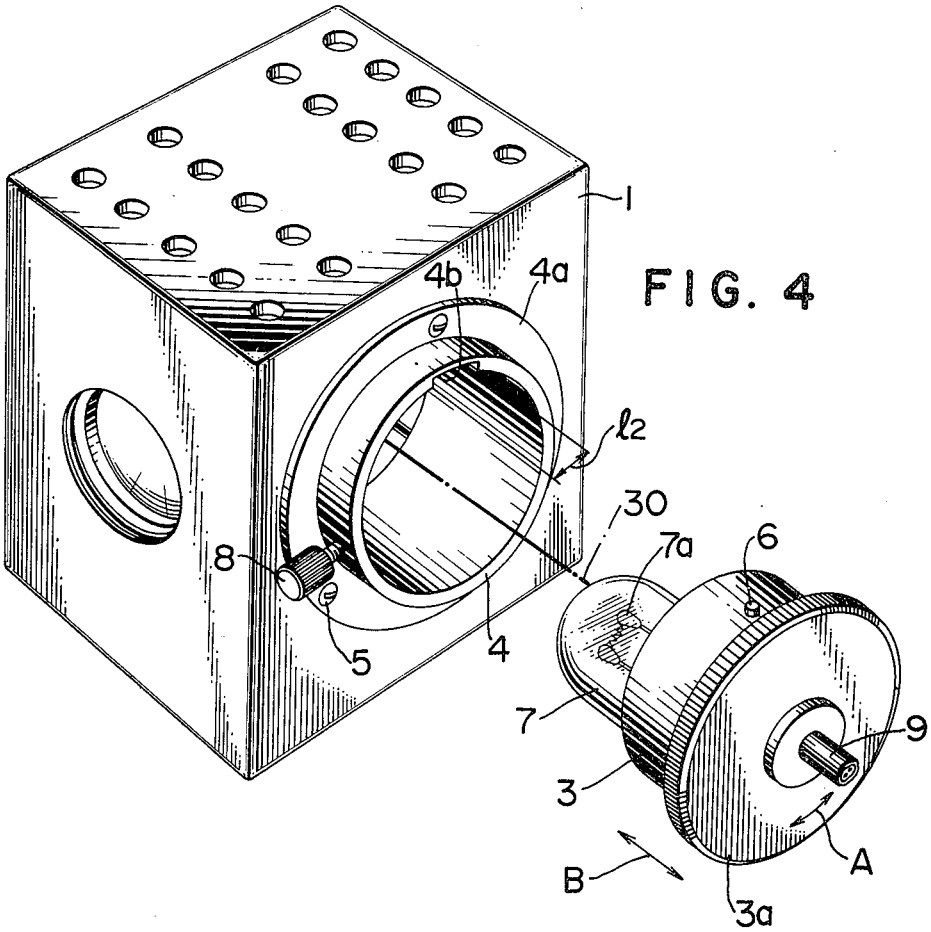
FIG. 4 is an exploded perspective view of the lamp socket and the sleeve.

In operation, when the lamp socket 3 is fitted into the sleeve 4, the operating knob 3*a* is grasped by hand to rotate the lamp socket about the axis 30 or in a direction indicated by a double-ended arrow A as shown in FIG. 4 or to move it along the axis 30 or in a direction indicated by a double-ended arrow B, before the lamp socket 3 is clamped to the sleeve 4 by the set screw 8. This results in a movement of the filament 7*a* relative to the condenser lens 2 in the direction of the arrow A or vertically as shown in FIG. 2, or results in a lateral movement of the filament 7*a* in the direction of the arrow B as shown in FIG. 3. When an optimum position of the lamp 7 relative to the condenser lens 2 is determined in this manner, the lamp socket 3 is clamped to sleeve 4 by the set screw 8. It will be noted that the pin 6 cooperates with the opposite lateral edges of the groove 4*b* to define an angular range through which the lamp socket 3 is rotatable, thereby preventing a large variation in the positional relationship between the lamp socket 3 and the condenser lens 2. Also, the pin 6 cooperates with the inner end face of the groove 4*b* to restrict a movement thereof in the direction of the arrow B, again preventing an excessive inward movement of the filament 7*a* beyond condenser lens 2. Thus it will be seen that the depth $l_1$ and the width $l_2$ of the groove 4*b* are chosen so that the filament 7*a* can not move out of the extent of condenser lens 2. It will be appreciated that the means for restricting the extent of rotation may be provided on the operating knob 3*a*.

In the apparatus of the invention, the pin 6 and the groove 4*b* may be provided on the lamp socket 3 and the sleeve 4, respectively, or vice versa. In addition to a lamp having a filament, the light source may comprise a lamp having no filament, such as a discharge lamp. While the lamp is shown to be disposed at right angles to the optical axis of the condenser lenses, it may be disposed parallel to the optical axis without restricting the applicability of the present invention. In addition to set screws, the means for clamping the lamp socket to the sleeve may comprise any other conventional means such as a plate-shaped spring member interposed between the lamp socket and the sleeve for providing a frictional coupling therebetween.

What is claimed is:

1. An apparatus for adjusting the light source position of a light source assembly, comprising a lamp socket for mounting a lamp at an eccentric position thereon, a sleeve secured to a lamp housing for mounting the lamp socket so as to be slidable along and rotatable about the axis thereof, and means for clamping the lamp socket to the sleeve, said lamp socket being moved along the axis or angularly moved about the axis relative to the sleeve so as to bring the lamp to a given position relative to a condenser lens disposed within the lamp housing before the lamp socket is clamped to the sleeve.

2. An apparatus for adjusting the light source position of a light source assembly according to claim 1 in which the lamp socket is in fitting engagement with the sleeve through a pin and groove connection which restricts the extent of movement of the lamp socket.

3. An apparatus for adjusting the light source position of a light source assembly according to claim 1 in which the means for clamping the lamp socket to the sleeve comprises set screw means.

4. An apparatus for adjusting the light source position of a light source assembly according to claim 1 in which the lamp is mounted on the lamp socket in a manner such that the brightest portion thereof is offset from the axis thereof.

* * * * *